US012269515B2

(12) United States Patent
Pfeifer et al.

(10) Patent No.: US 12,269,515 B2
(45) Date of Patent: Apr. 8, 2025

(54) PASSAGE DETECTION FOR A CABLEWAY

(71) Applicant: Innova Patent GmbH, Wolfurt (AT)

(72) Inventors: Daniel Pfeifer, Sankt Anton am Arlberg (AT); Adrian Mohni, St. Gallen (CH)

(73) Assignee: INNOVA PATENT GMBH, Wolfurt (AT)

( * ) Notice: Subject to any disclaimer, the term of this patent is extended or adjusted under 35 U.S.C. 154(b) by 815 days.

(21) Appl. No.: 17/432,312

(22) PCT Filed: Mar. 10, 2020

(86) PCT No.: PCT/EP2020/056305
§ 371 (c)(1),
(2) Date: Aug. 19, 2021

(87) PCT Pub. No.: WO2020/182791
PCT Pub. Date: Sep. 17, 2020

(65) Prior Publication Data

US 2022/0169290 A1 Jun. 2, 2022

(30) Foreign Application Priority Data

Mar. 11, 2019 (AT) ..... A 50200/2019

(51) Int. Cl.
*B61B 12/06* (2006.01)
*B61B 12/02* (2006.01)
(Continued)

(52) U.S. Cl.
CPC ..... *B61B 12/06* (2013.01); *B61B 12/02* (2013.01); *B61B 10/02* (2013.01); *B61B 10/027* (2013.01); *B61B 11/00* (2013.01)

(58) Field of Classification Search
CPC ..... B61B 12/06; B61B 12/02; B61B 7/00; B61B 10/02; B61B 10/027; B61B 11/00; B61B 1/02
(Continued)

(56) References Cited

U.S. PATENT DOCUMENTS 4,003,314 A * 1/1977 Pearson ..... B61B 12/06 104/178
5,105,745 A 4/1992 Tarassoff
(Continued)

FOREIGN PATENT DOCUMENTS

CN 102325681 A 1/2012
CN 104097644 A 10/2014
(Continued)

OTHER PUBLICATIONS

Austrian Office Action; Application No. A50200/2019; Issued: Feb. 2, 2020; 2 Pages.
(Continued)

*Primary Examiner* — Zachary L Kuhfuss
(74) *Attorney, Agent, or Firm* — Husch Blackwell LLP

(57) ABSTRACT

In order to enhance the safety of a cableway, in particular when a cable car passes through a cableway support of the cableway, according to the present teaching a detection device having at least one evaluation unit and at least two sensors connected to the evaluation unit is provided on at least one cableway support. A first sensor is located in the entry area of the cableway support in order to detect the presence of a cable car in a detection area of the first sensor. A second sensor is located in the exit area of the cableway support in order to detect the presence of a cable car in a detection area of the second sensor. The detection device is provided in order to detect a number of cable cars between the first sensor and the second sensor and to generate a fault
(Continued)

signal when the detected number exceeds a predefined maximum number.

12 Claims, 2 Drawing Sheets

(51) Int. Cl.
*B61B 10/02* (2006.01)
*B61B 11/00* (2006.01)

(58) Field of Classification Search
USPC ..... 104/173.2, 178
See application file for complete search history.

(56) References Cited

U.S. PATENT DOCUMENTS

| | | | | |
|---|---|---|---|---|
| 5,528,219 | A * | 6/1996 | Frohlich | B61B 12/06 340/521 |
| 7,764,169 | B2 * | 7/2010 | Rowell | H04L 69/40 340/508 |
| 7,802,523 | B2 | 9/2010 | Moritzhuber et al. | |
| 7,880,633 | B2 | 2/2011 | Thum | |
| 8,096,890 | B2 * | 1/2012 | Anderson | B61B 7/04 472/36 |
| 9,616,350 | B2 * | 4/2017 | Stenzler | G01J 1/0295 |
| 11,679,793 | B2 * | 6/2023 | Pfeifer | B61L 27/57 701/19 |
| 2007/0221088 | A1 | 9/2007 | Hinteregger | |
| 2021/0024110 | A1 * | 1/2021 | Pfeifer | B61B 12/002 |

FOREIGN PATENT DOCUMENTS

| | | | |
|---|---|---|---|
| CN | 204323338 | U | 5/2015 |
| EP | 0461954 | A1 | 12/1991 |
| EP | 1364853 | A1 | 11/2003 |
| EP | 1837264 | A2 | 9/2007 |
| EP | 1953062 | A1 | 8/2008 |
| EP | 2147843 | A1 | 1/2010 |
| EP | 2389306 | A1 | 11/2011 |
| JP | 863279962 | A | 11/1988 |
| JP | S63279962 | A | 11/1988 |
| JP | H02234873 | A | 9/1990 |
| JP | H0314761 | A | 1/1991 |
| JP | H05229432 | A | 9/1993 |
| JP | H07277180 | A | 10/1995 |
| JP | H10119763 | A | 5/1998 |
| JP | H10338331 | A | 12/1998 |
| JP | 2008001180 | A | 1/2008 |
| JP | 2016049972 | A | 4/2016 |
| WO | 2010084271 | A1 | 7/2010 |

OTHER PUBLICATIONS

International Search Report and Written Opinion of the International Searching Authority; Application No. PCT/EP2020/056305; Completed: Jul. 13, 2020; Mailing date: Jul. 22, 2020; 12 Pages.
Office Action dated Apr. 26, 2023 in Chinese Patent Application No. 202080020337.2.

* cited by examiner

PASSAGE DETECTION FOR A CABLEWAY

TECHNICAL FIELD

The present teaching relates to a cableway with two end stations between which at least one cable car can be moved on at least one conveyor cable and with at least one cableway support arranged between the end stations for guiding the at least one conveyor cable, wherein the cableway support extends in the longitudinal direction of the conveyor cable over a cableway support length between two opposing support ends, wherein in the area of a first support end an entry area is provided for the entry of the cable car into the cableway support and in the area of the second end of the support an exit area is provided for the exit of the cable car from the cableway support. The present teaching further relates to a detection device for a cableway support of a cableway, which support extends in the longitudinal direction of a conveyor cable guided on the cableway support over a cableway support length between two opposing support ends, for detecting the passage of cable cars, and a method for detecting the passage of cable cars on a cableway support of a cableway, which support extends in the longitudinal direction of a conveyor cable guided on the cableway support over a cableway support length between two opposing support ends, wherein at least one cable car is moved on the conveyor cable over the cableway support.

BACKGROUND

Cableways are available in a wide variety of designs, mostly for transporting people and/or goods, for example as urban means of transport or for transporting people in ski areas. Funiculars are known in which mostly rail-bound vehicles are fastened to a wire cable in order to be pulled by the wire cable. The movement takes place on the ground, with funiculars mostly used on mountain routes or in urban areas. In the case of aerial cableways, on the other hand, cable cars such as gondolas, cabins or chairs are carried by one or more (wire) cables without fixed guides and moved while hanging in the air. The cable cars therefore have no contact with the ground. Aerial cableways are usually used in rough terrain, mostly for mountain routes, for example in ski areas, to transport people from the valley to a mountain, but also in urban areas for transporting people. As a rule, cableways have two or more stations between which the cable cars are moved.

A distinction must be made between circulating cableways and aerial cableways. In the case of aerial cableways, one or two cable cars pulled by a traction cable commute back and forth on a conveyor cable or on rails on a route between two stations. The circulating cable car, on the other hand, has an endless conveyor cable which is constantly circulating between the stations and on which a large number of cable cars such as gondolas or chairs are suspended. The cable cars are moved from one station to the other on one side and back again on the opposite side. The movement of the cable cars is therefore always substantially continuous in one direction, analogous to a continuous conveyor.

In order to be able to bridge greater distances, one or more cableway supports for guiding the (carrying/traction) cable(s) are usually arranged between the two stations. Cable car supports can be designed as a steel framework construction, but also as a steel tube or sheet metal box construction. A plurality of rollers, for example in the form of a so-called roller set, are usually arranged on a cableway support in order to carry and guide the cable. In the case of circulating cableways, the cable cars are usually fastened to the conveyor cable at a defined distance from one another. In order to ensure that the conveyor cable and the cableway supports are loaded as evenly as possible, the distances between the large number of cable cars on a cableway are usually the same. The distance between the cable cars can of course vary depending on the specific design of a cableway. For example, the distance between the chairs of a chairlift will be smaller than the distance between the gondolas of a gondola cableway, etc.

In modern circulating cableways, the cable cars are usually not permanently connected to the conveyor cable, but are connected by means of openable cable clamps. As a result, in the stations the cable cars can be decoupled from the conveyor cable and moved through the station at a speed that is lower than the speed of the conveyor cable. In particular when transporting passengers, this increases the comfort and safety for the passengers because more time is available for getting on and off. When exiting the station, the cable cars are then clamped to the conveyor cable again by means of the cable clamps. The cable cars are preferably accelerated again to the speed of the circulating conveyor cable in order to avoid abrupt acceleration and shock loads. Due to the development toward greater conveying capacity and shorter transport times, in addition to the size and capacity of the cable cars, the conveying speed of the conveyor cable has of course also increased in recent years. The fact that the cable cars are decoupled in the stations and the conveying speeds are ever increasing must of course also be taken into account when setting the distance between the individual cable cars. There are also cableways with cable cars firmly clamped to the conveyor cable.

As a rule, the distances between the cable cars mean that there is only one cable car on a cableway support (at least in one direction of travel) between an entry area into the roller set and an exit area from the roller set. To increase the operational safety of the cableway and the safety of the passengers and to reduce the risk of damage, cable position sensors are often provided on the roller sets. The cable position sensors are provided in order to detect a deviation of the position of the conveyor cable in the roller set from a desired cable position predefined by the rollers. If a deviation is detected, the cableway can be stopped under certain circumstances, the speed can be reduced and/or a warning signal can be output. This increases safety, especially at high wind speeds, because, for example, the conveyor cable jumping out of the rollers of the roller set can be reliably detected. Under certain circumstances, the operation of the cableway can be maintained for a longer period of time.

However, situations can arise in which no deviating cable position is detected, but which can nevertheless lead to damage and/or can endanger the passengers. For example, a cable car could swing around the conveyor cable transversely to the direction of movement, for example due to gusts of wind, without the cable position of the conveyor cable in the roller set of a cableway support deviating in an impermissible manner from the target cable position. If the swinging movement is too strong when the cable car is entering or passing to through the roller set of a cableway support, areas of the cable car may collide with areas of the cableway support. In the worst case, such a collision can block the cable car in the area of the cableway support without the cable position sensor detecting a different cable position. For safety reasons, the cable clamps are usually designed in such a way that, when there is a certain resistance between the cable car and the conveyor cable, they allow the conveyor cable to slip through (without loosening the clamp, of course). Such a blocked cable car cannot be easily detected by the cable car control. If the cableway support cannot be seen from a cable car station, a blocked cable car cannot be recognized by the operating staff.

The scenario described could consequently lead to the cable car being blocked in the area of a cableway support and the conveyor cable being moved through the cable clamp at a substantially unchanged speed relative to the cable car. This could then lead to a subsequent cable car entering the area of the cableway support and colliding with the cable car already blocked therein and in turn being blocked. If the cable position also does not change impermissibly, this can lead to a chain reaction resulting in a collision of further following cable cars.

SUMMARY

One object of the present teaching is therefore to increase the safety of a cable car, in particular when a cable car travels through a cableway support of the cable car.

The object is achieved according to the present teaching in that a detection device with at least one evaluation unit and with at least two sensors connected to the evaluation unit is provided on at least one cableway support, wherein a first sensor is arranged in the entry area of the cableway support to detect the presence of a cable car in a detection area of the first sensor, and a second sensor is arranged in the exit area of the cableway support to detect the presence of a cable car in a detection area of the second sensor, wherein the detection device is configured to determine a number of cable cars between the first sensor and the second sensor and to generate a fault signal if the determined number exceeds a predetermined maximum number.

The cableway preferably has a control unit for controlling the cableway which is configured to process the fault signal of the detection device, wherein the control unit controls the cableway as a function of the processing. This means that the cableway can, for example, be switched off automatically if a fault signal is present. Alternatively, or in addition, a preferably optical and/or acoustic warning signal can also be automatically emitted when a fault signal is received, for example in order to notify the operating staff of the location of the fault.

The sensors are preferably provided to generate a sensor value when the presence of a cable car is detected in the detection area of the sensor and to transmit it to the evaluation unit, and the evaluation unit is configured to process the received sensor values in order to determine the number of cable cars between the first sensor in the entry area and the second sensor in the exit area of the cableway support and to generate the fault signal if the determined number exceeds the predetermined maximum number. This relatively simple structure enables reliable detection of the passage of cable cars.

The evaluation unit is advantageously configured to increment a counter value by a step value if the first sensor in the entry area supplies a sensor value and to decrement the counter value by a step value if the second sensor in the exit area supplies a sensor value or vice versa, and the evaluation unit is provided to generate the fault signal when the counter value exceeds a predetermined counter value. As a result, a relatively simple logic of passage detection is implemented.

An initial counter value equal to zero is preferably provided and a step value of one is provided, wherein the evaluation unit is configured to generate the fault signal when the counter value is greater than one. As a result, the evaluation unit recognizes when there is more than one cable car between the entry area and the exit area, when the counter value exceeds the value one and can trigger a fault signal.

According to a further advantageous embodiment, it is provided that for redundant determination of the number of cable cars and/or for determining a direction of movement of a cable car at least two longitudinally spaced sensors are provided in the entry area and at least two longitudinally spaced sensors are provided in the exit area of the cableway support. This makes it possible, for example, to meet the requirements of a certain SIL level (safety integrity level) and to minimize the risk of failure of the detection device.

Preferably, at least one evaluation unit is provided per cableway support in order to process the sensor values of the sensors of the respective cableway support, or an evaluation unit is provided for a plurality of cableway supports in order to process the sensor values of the sensors of the plurality of cableway supports. The number of sensors to be evaluated can thus be adapted to the performance of the evaluation unit or vice versa. If a cableway has a sufficiently powerful control unit, a separate evaluation unit could also be dispensed with and the sensor values could be evaluated in the control unit.

At least one sensor is preferably an inductive sensor which is provided to detect a cable clamp of a cable car by which the cable car is attached to the conveyor cable. This enables simple and robust identification of the cable car.

The object is further achieved with a detection device in that the detection device has at least one evaluation unit and at least two sensors connected to the evaluation unit, wherein at least one first sensor is provided in an entry area at a first support end to detect the presence of a cable car in a detection area of the first sensor and at least one second sensor is to provided for arrangement in an exit area at the second support end of the cableway support in order to detect the presence of a cable car in a detection area of the second sensor and that the detection device is configured to determine a number of cable cars between the first sensor and the second sensor and to generate a fault signal if the determined number exceeds a predetermined maximum number.

Furthermore, the object is achieved by a method for passage detection in that the cable car is moved into an entry area provided in the area of a first support end of the cableway support, wherein at least one first sensor provided in the entry area detects the presence of the cable car in a detection area of the first sensor and transmits a sensor value to an evaluation unit, and the cable car is moved from the entry area into an exit area of the cableway support provided in the area of the second support end, wherein at least one second sensor provided in the exit area detects the presence of the cable car in a detection area of the second sensor and transmits a sensor value to the evaluation unit, and the evaluation unit processes the received sensor values in order to determine a number of cable cars between the first and second sensor and generates a fault signal if the determined number exceeds a predefined maximum number.

BRIEF DESCRIPTION OF THE DRAWINGS

The present teaching is described in greater detail below with reference to FIGS. 1 to 2*c* which show, by way of example, advantageous embodiments of the present teaching in a schematic and non-limiting manner. In the drawings.

DETAILED DESCRIPTION

Figure 1:
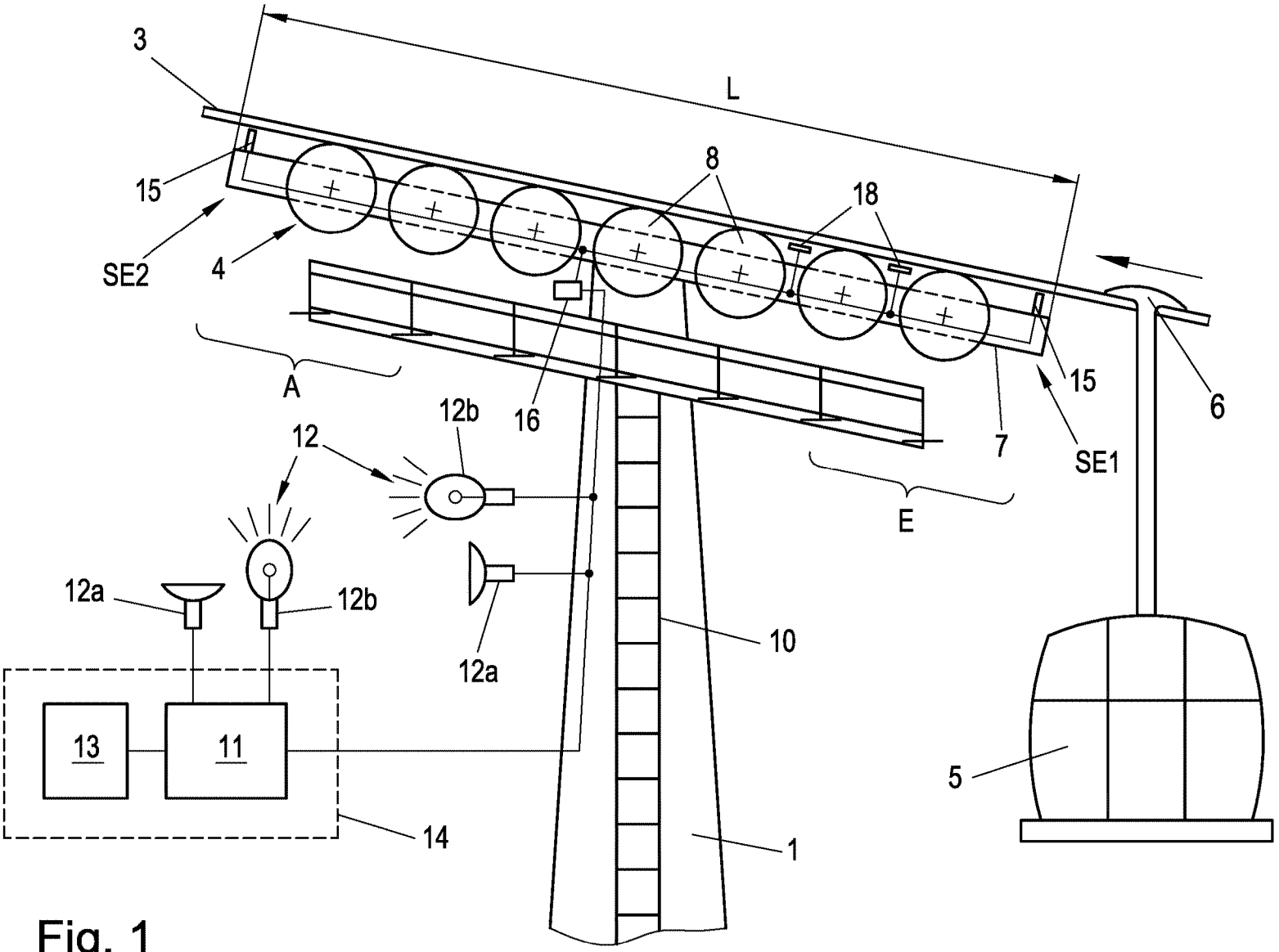
FIG. 1 shows an upper section of a cableway support of a cableway with a conveyor cable and a cable car fastened to it in a side view.

FIG. 1 shows a cableway support 1 of a cableway on which a conveyor cable 3 of the cableway is guided by means of a roller set 4. A cable car 5 is suspended (openably or fixedly clamped) from the conveyor cable 3 by means of a cable clamp 6. The cableway is designed here as a circulating cableway, in particular as a gondola cableway, the cable car 5 being designed as a gondola. Of course, other variants of cable cars would also be conceivable, such as, for example, a chair lift with a cable car 5 designed as a chair or also drag lifts with brackets. Mixed operation with a gondola alternating with a chair would also be possible. As a rule, the cableway has two end stations 14 (not shown in greater detail), between which a plurality of cable cars 5 are usually moved by means of the conveyor cable 3. For this purpose, the cable cars 5 are fastened to the conveyor cable 3 at a certain predetermined distance from one another, the fastening preferably taking place by means of cable clamps 6. In some embodiments, a plurality of parallel conveyor cables 3 and, if applicable, a traction cable which circulates or runs back and forth can also be provided. In the following example, however, the present teaching is explained using only one conveyor cable 3, but of course the present teaching can also be applied to cable cars with a plurality of conveyor cables 3 and/or traction cables.

At least one cableway support 1 is arranged between the end stations 14 of the cableway, and a plurality of cableway supports 1 are usually provided. The number of cableway supports 1 depends, for example, on the distance between the end stations 14 of the cableway and on the expected load from the cable car 5, but also on the topology of the terrain in which the cableway is operated. The cableway supports 1 are used to carry and guide the conveyor cable 3. For the sake of simplicity, only an upper section of a cableway support 1 is shown in FIG. 1, as well as only a cable car 5 and a section of the conveyor cable 3 in the area of the cableway support 1. To guide the conveyor cable 3, a so-called roller set 4 is arranged on the cableway support 1. The roller set 4 can have a longitudinal beam 7 on which a plurality of rollers 8 are arranged one behind the other. The rollers 8 are rotatably mounted on the roller set 4, for example on the longitudinal beam 7, and serve to carry the conveyor cable 3 and to guide it laterally. The roller set 4 thus supports the load of the conveyor cable 3 including the cable car 5 fastened thereto via the cableway support 1 on the ground.

The cableway support 1 extends in the longitudinal direction of the conveyor cable 3 over a certain cableway support length L between two opposing support ends SE1, SE2. In the area of a first support end SE1 there is an entry area E for the entry of the cable car 5 into the cableway support 1, and an exit area A for the exit of the cable car 5 from the cableway support 1 is provided in the area of the second support end SE2. In the example shown, the support ends SE1, SE2 are formed by the ends of the roller set 4. Of course, the support ends SE1, SE2 could also be provided on another part of the cableway support 1, for example on a guide device for guiding the conveyor cable 3 or on a maintenance platform of the cableway support 1. The length of the entry area E and the exit area A is advantageously up to a third of the cableway support length L of the cableway support 1.

In the example shown, the movement of the cableway in normal operation takes place in such a way that the cable car 5 is moved from the right or bottom to the left or top, as indicated by the arrow. This means that the cable car 5 enters the entry area E of the cableway support 1 or in particular the roller set 4, is then moved along the roller set 4 to the exit area A and is moved out of the roller set 4 in the exit area A. If the direction of the cableway is reversed, the sequence is of course reversed accordingly. The cableway support 1 can also have an opposing second roller set 4 (not shown) in a circulating cableway, which serves to guide the opposing part of the circulating conveyor cable 3. On the second roller set 4, the entry area E and the exit area A are reversed. The second roller set 4 functions in an analogous manner.

According to the present teaching, a detection device 9 with at least one evaluation unit 16 and with at least two sensors 15 connected to the evaluation unit 16 is provided on at least one cableway support 1 of the cableway. In this case, the first sensor 15 is arranged in the entry area E of the cableway support 1 in order to detect the presence of a cable car 5 in a detection area of the first sensor 15. A second sensor 15 is arranged in the exit area A of the cableway support 1 in order to detect the presence of a cable car 5 in a detection area of the second sensor 15. The detection device 9 is provided to determine a number i of cable cars 5 between the first sensor 15 and the second sensor 15 and to generate a fault signal F if the determined number i exceeds a predetermined maximum number $i_{max}$. The cable car preferably also has a control unit 11 for controlling the cableway, the control unit being provided to process the fault signal F of the detection device 9 and to control the cableway depending on the processing. As a result, the control unit 11 can intervene in the operation of the cableway, for example to shut down the cableway, to reduce the conveying speed and/or to generate an acoustic and/or visual warning signal by means of a signaling device 12, for example at an output unit of the control unit 11. The control unit 11 is only shown schematically in FIG. 1 and can be arranged, for example, in an end station 14 in order to control a drive device 13 of the cable car, such as an electric motor, when the control unit 11 receives the fault signal F from the detection device 9.

The signaling device 12 could, for example, have a loudspeaker 12*a* for emitting an acoustic warning signal and/or a lighting unit 12*b* for emitting an optical warning signal and/or an output on an output unit, such as a display. The signaling device 12 can be provided, for example, in one or both of the end stations 14 and/or on one or more cableway supports 1. When arranged in an end station 14, the warning signal could, for example, be perceived by operating staff in the end station 14 without a direct view of the cableway support 1, at which the fault signal F is generated by the detection device 9.

The sensors 15 are advantageously provided to generate a sensor value SW upon detection of the presence of the cable car 5 in the detection area of the sensor 15 and to transmit it to the evaluation unit 16. The evaluation unit 16 is preferably configured to process the sensor values SW obtained in order to determine the number i of cable cars 5 between the first sensor 15 in the entry area E and the second sensor 15 in the exit area A of the cableway support 1. If the determined number i exceeds the specified maximum number $i_{max}$, the evaluation unit 16 generates a fault signal F and preferably transmits the fault signal F to the control unit 11 of the cable car. If one or more cable position sensors 18 for detecting a cable position of the conveyor cable 3 are provided on the roller set 4 as described above (indicated in FIG. 1), the sensors 15 of the detection device 9 could, for example, also be connected to the evaluation unit of the cable position sensors 18, which unit then also functions as an evaluation unit 16 of the detection device 9. The reverse case would of course also be conceivable, in which the cable position sensors 18 are connected to the evaluation unit 16 of the detection device 9. The evaluation unit 16 of the detection device 9 (or the evaluation unit of the cable position sensors 18) could then be provided, for example, both for evaluating the sensor values SW of the sensors 15 of the detection device 9 and for evaluating the cable position sensors 18. Of course, a separate evaluation unit (not shown) could also be provided for the cable position sensors 18, the separate unit communicating, for example, with the evaluation unit 16 and/or with the control unit 11 of the cable car. The cable position sensors 18 could also function as sensors 15 for detecting the passage of the cable car 5 in addition to detecting the cable position.

Advantageously, for redundant determination of the number i of cable cars 5, at least two sensors 15 spaced apart in the longitudinal direction are provided in the entry area E and at least two sensors 15 spaced apart in the longitudinal direction are provided in the exit area A of the cableway support 1. Such a redundant design of the sensor system enables certain functional safety requirements to be met, such as a level SIL3 (safety integrity level 3). Depending on the SIL level, various requirements must be met in order to minimize the risk of a system malfunction. Details in this regard are known to a person skilled in the art. In the example shown with only one sensor 15 in each case in the entrance and exit areas E, A, for example, the failure of one sensor 15 would lead to the failure of the entire system. As a result of the redundant design, normal functioning of the detection device 9 would be guaranteed even if a sensor 15 in the entrance or exit area E, A fails. The evaluation unit 16 is preferably provided to detect a failure or a malfunction of a sensor 15, for example to transmit it to the control unit 11. The control unit 11 could, for example, output a corresponding signal, for example via a display screen, in order to signal the failure or malfunction to the operating staff. As a result, the corresponding sensor 15 could be serviced at an early stage or, if necessary, replaced before the entire detection device 9 fails.

The arrangement of at least two sensors 15 in the entry area E and in the exit area A can advantageously also be used to determine a direction of movement of the cable car 5. For this purpose, the sensors 15 are arranged one behind the other at a distance from one another in the direction of movement. As a result, the cable car 5 is recognized and the sensor values SW are generated with a time delay when the cable car 5 passes the sensors 15.

At least one evaluation unit 16 is preferably provided for each cableway support in order to process the sensor values SW of the sensors 15 of the respective cableway support 1. However, an evaluation unit 16 could also be provided for a plurality of cableway supports 1 in order to process the sensor values SW of the sensors 15 of the plurality of cableway supports 1. The communication between the supports that is necessary for this could for example take place in a wired manner via cables or wirelessly, for example via radio. For example, for a redundant implementation of the signal processing, at least two evaluation units 16 could also be provided on a cableway support 1 in order to meet the requirements of a specific SIL level.

According to an advantageous embodiment of the present teaching, at least one sensor 15 is designed as an inductive sensor which is provided to detect part of the cable car 5, in particular the cable clamp 6 of the cable car 5. However, all sensors 15 are preferably inductive sensors. The structure and mode of operation of inductive sensors are known in the prior art. Essentially, an inductive sensor uses a coil to generate a magnetic field in the vicinity of the sensor. If an electrically conductive object penetrates into the detection area of the sensor, the magnetic field is changed and the change in the magnetic field is recognized by the sensor, the sensor generating a sensor value SW. In the present example in FIG. 1, an inductive sensor 15 is arranged in the entry area E on the longitudinal beam 7 of the roller set 4 and an inductive sensor 15 is arranged in the exit area A on the longitudinal beam 7 of the roller set 4. The sensors 15 are arranged in such a way that when the cable car 5 passes by they interact with the cable clamp 6 in order to generate a sensor value SW. The cable clamp 6 is usually made entirely of an electrically conductive material or has at least one area with an electrically conductive material that interacts with the (inductive) sensors 15.

The sensors 15 are connected to the evaluation unit 16 in order to transmit the sensor values SW to the evaluation unit 16. The connection is preferably made via suitable lines, as indicated in FIG. 1, but could alternatively also be made wirelessly. The evaluation unit 16 processes the received sensor values SW and uses them to determine the number i of cable cars 5 that are located between the entry area E and the exit area A, in particular between the respectively arranged sensors 15.

The evaluation is preferably carried out by the evaluation unit 16 in that the evaluation unit 16 increments a counter value Z by a step value W if a first sensor 15 in the entry area E supplies a sensor value SW, and decrements the counter value Z by a step value W if a second sensor 15 in the exit area A supplies a sensor value SW, or vice versa. If the counter value Z exceeds a predetermined counter value $Z_V$, the evaluation unit 16 generates the fault signal F and preferably sends it to the control unit 11 of the cableway. The evaluation unit 16 could also send the fault signal F directly to a signaling device 12 in order to generate an acoustic and/or optical signal. The evaluation unit 16 is therefore used to detect the passage of cable cars 5, the method of passage detection being explained in more detail below with reference to FIGS. 2*a*-2*c*.

Figure 2A:
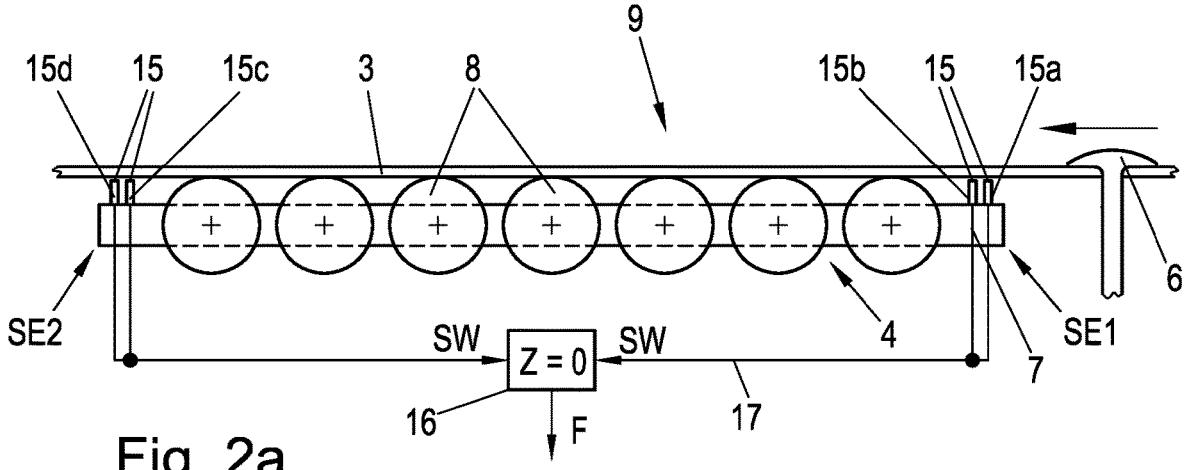
FIGS. 2*a*-2*c* show a roller set of a cableway support with a cable clamp of a cable car in different positions.
Figure 2B:
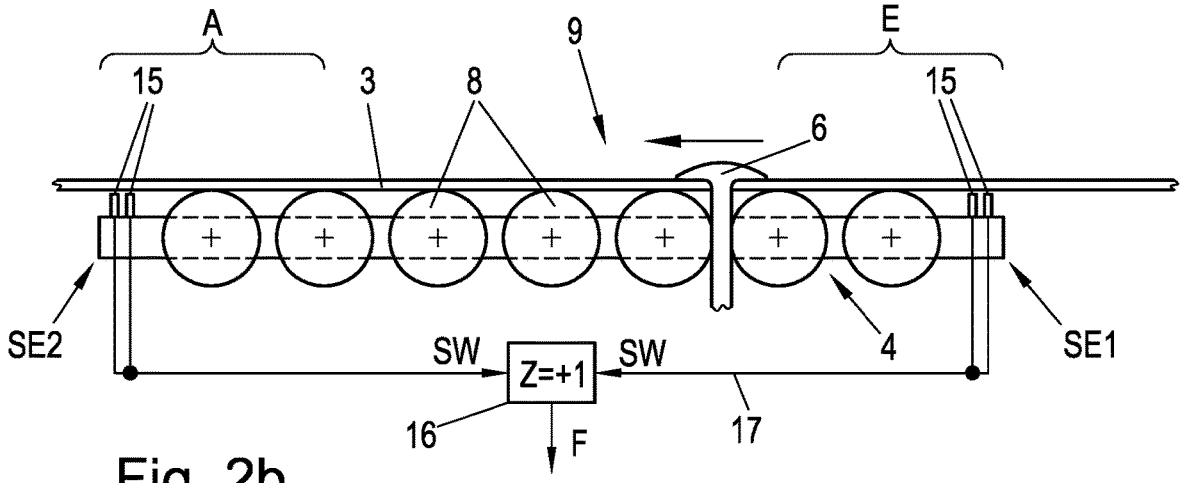
Figure 2C:
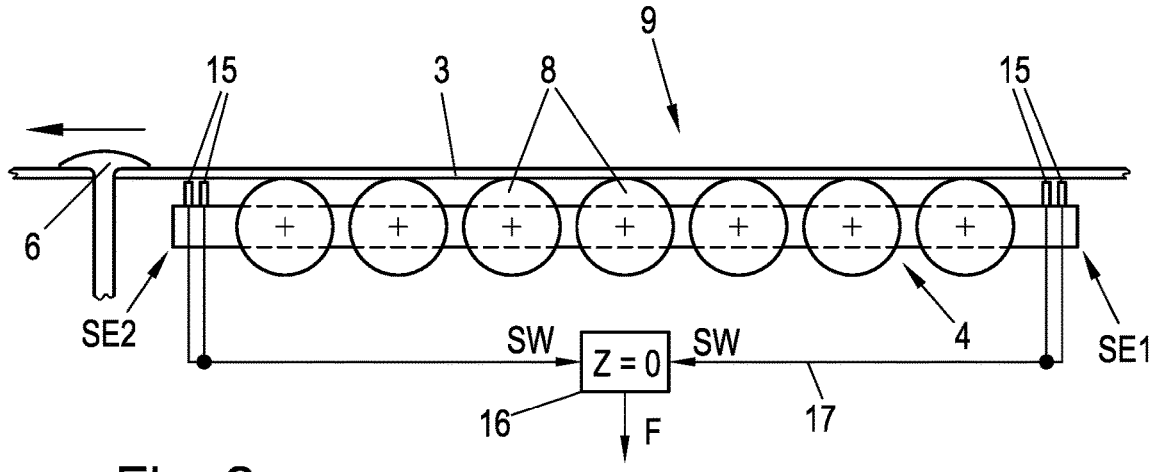

FIGS. 2*a*-2*c* show an advantageous sequence of the method according to the present teaching on the basis of a simplified illustration of a roller set 4 of a cableway support 1 (not shown). The support ends SE1, SE2 are formed by the ends of the longitudinal beam 7 of the roller set 4. The entry area E for the cable car 5 is provided in the area of the first support end SE1 and the exit area A for the cable car 5 is provided in the area of the second support end SE2. A cable car 5 is fastened to the conveyor cable 3 with a cable clamp 6, wherein the cable car 5 is only partially shown for reasons of clarity. As a result of the movement of the conveyor cable 3, the cable clamp 6 with the cable car 5 suspended on it is moved over the roller set 4, in this case from right to left, as indicated by the arrow. As soon as the cable clamp 6 comes into the detection range of the first sensor 15, the sensor 15 detects the presence of the cable clamp 6, generates a sensor value SW and sends it to the evaluation unit 16, for example via a suitable sensor line 17. In the example shown, for reasons of redundancy, two sensors 15 are provided one behind the other in the entry area E and in the exit area A in the direction of movement of the conveyor cable 3. The entry area E and exit area A preferably each extend over a length that is up to a third of the cableway support length L, i.e., over a third of the length of the longitudinal beam 7 of the roller set 4 in the example shown. In order to increase the range of passage detection, it is advantageous if the sensors are each arranged as close as possible to the respective support end SE1, SE2.

In addition to increasing the reliability, the sensors 15 could be used, as described, to determine the direction of movement. The evaluation unit 16 could process the sensor values SW of all sensors 15 of the cableway support 1, but could, for example, also ignore certain sensor values SW. For example, after receiving a sensor value SW, a specific dead time t could be implemented, within which the evaluation unit 16 ignores further received sensor values SW. The dead time t could for example be determined depending on a speed of the conveyor cable 3 and a distance between the two sensors 15 of the entry and/or exit area E, A. This could mean that the evaluation unit 16, after receiving a sensor value SW of the first sensor 15, ignores further sensor values SW during a defined dead time t, in this case for example the sensor value SW of the second sensor 15*b*.

After the dead time t has elapsed, the evaluation unit 16 could, for example, use the next received sensor value SW for evaluation, in this case the sensor value SW of the third sensor 15*c*. After the sensor value SW of the third sensor 15*c* is received, a dead time t could again be implemented in order to ignore a further received sensor value SW (in this case from the fourth sensor 15*d*). Of course, the evaluation unit 16 could also be provided to process the sensor values SW in pairs, substantially redundantly. For example, a malfunction or failure of a sensor 15 could be determined from this.

However, it would also be conceivable, for example, for a specific predetermined transit time of the cable car 5 to be implemented in the evaluation unit 16. The transit time can result, for example, from a speed of the conveyor cable 3 (which corresponds to the speed of the cable car 5) and a distance between the sensor(s) 15 in the entry area E and the sensor(s) 15 in the exit area A. The evaluation unit 16 could then, for example, also generate a fault signal F if a time between the reception of the sensor value SW of the sensor(s) 15 in the entry area E and the reception of the sensor value SW of the sensor(s) 15 in the exit area A exceeds the specified transit time, possibly taking into account a certain tolerance time. The transit time could, for example, also be determined from a current speed of the conveyor cable 3, which could be provided, for example, by the control unit 11 or could be determined by the evaluation unit 16 via the sensors 15 (in normal operation at constant speed if there is no disruption over the distance between the sensors 15 and the time between the reception of the sensor values SW). Furthermore, the speed of the conveyor cable 3 could also be determined by other sensors of the cableway support 1 and transferred to the evaluation unit 16, for example by the cable position sensors 18 for detecting the cable position.

An initial counter value Z=0 and a step value W=1 are preferably provided in the evaluation unit 16, wherein the evaluation unit is configured to generate the fault signal F when the counter value is Z>1, as shown in the example. In FIG. 2*a*, the cable clamp 6 of the cable car 5 moves in the direction of the cableway support 1, but is still in front of the entry area E. The initial counter value Z is Z=0. In FIG. 2*b*, the cable clamp 6 has passed the sensors 15 of the entry area E and is located on the roller set 4 between the entry area E and the exit area A. At least one of the sensors 15 of the entry area E has transmitted a sensor value SW to the evaluation unit 16, as a result of which the evaluation unit 16 increments the initial counter reading from Z=0 by a step value W=1 to a counter value Z=1. In FIG. 2*c*, the cable clamp 6 has passed the sensors 15 of the exit area A. At least one of the sensors 15 of the exit area A has transmitted a sensor value SW to the evaluation unit 16, as a result of which the evaluation unit 16 decrements the counter value Z=1 by a step value W=1 to a counter value Z=0. The fact that the counter value Z does not exceed the counter value Z=1 means that only one cable clamp 6 and thus only one cable car 5 is or has been located between the entry area E and the exit area A.

For example, if a cable car 5 were to become blocked between the entry area E and the exit area, as described above, and a cable clamp 6 of a subsequent cable car 5 were to pass through the entry area E, the counter value Z=1 would increase by a step value W to a counter value Z=2. As a result, the evaluation unit 16 would trigger a fault signal F and would preferably send it to the control unit 11 of the cableway in order to stop the cableway if necessary. The evaluation unit 16 preferably has a memory unit (not shown) in order to store the current counter value Z in the event that the cableway is switched off. As a result, the passage detection can be continued after the cableway starts up again.

Of course, the described embodiment of the present teaching is only to be understood as an example and it is at the discretion of a person skilled in the art to make certain structural changes to the detection device 9 and/or changes to the evaluation logic. For example, other sensors 15 could also be used which are suitable for detecting the cable car. For example, optical sensors, capacitive sensors, light barriers, magnetic sensors, mechanical sensors, etc. would be conceivable.

The invention claimed is:

1. A cableway with two end stations between which at least one cable car can be moved on at least one conveyor cable and with at least one cableway support arranged between the end stations for guiding the at least one conveyor cable, wherein the cableway support extends in the longitudinal direction of the conveyor cable over a cableway support length between two opposing support ends, wherein in the area of a first support end an entry area is provided for the entry of the cable car into the cableway support and in the area of the second support end an exit area is provided for the exit of the cable car from the cableway support, wherein a detection device with at least one evaluation unit and with at least two sensors connected to the evaluation unit is provided on at least one cableway support, wherein a first sensor is arranged in the entry area of the cableway support to detect the presence of a cable car in a detection area of the first sensor, and a second sensor is arranged in the exit area of the cableway support to detect the presence of a cable car in a detection area of the second sensor, wherein the detection device is configured to determine a number of cable cars between the first sensor and the second sensor and to generate a fault signal if the determined number exceeds a predetermined maximum number.

2. The cableway according to claim 1, wherein the cableway has a control unit for controlling the cableway, the control unit being configured to process the fault signal of the detection device, wherein the control unit controls the cableway depending on the processing.

3. The cableway according to claim 1, wherein the sensors are provided to generate a sensor value when the presence of a cable car is detected in the detection area of the sensor, and to transmit it to the evaluation unit, and the evaluation unit is configured to process the received sensor values in order to determine the number of cable cars between the first sensor in the entry area and the second sensor in the exit area of the cableway support and to generate the fault signal if the determined number exceeds the predetermined maximum number.

4. The cableway according to claim 3, wherein for redundant determination of the number of cable cars and/or for determining a direction of movement of a cable car at least two longitudinally spaced sensors are provided in the entry area and at least two longitudinally spaced sensors are provided in the exit area of the cableway support.

5. The cableway according to claim 3, wherein at least one sensor is an inductive sensor which is provided to detect a cable clamp of a cable car by which the cable car is attached to the conveyor cable.

6. The cableway according to claim 1, wherein the evaluation unit is configured to increment a counter value by a step value if the first sensor in the entry area supplies a sensor value and to decrement the counter value by a step value if the second sensor in the exit area supplies a sensor value, or vice versa, and the evaluation unit is provided to generate the fault signal when the counter value exceeds a predetermined counter value.

7. The cableway according to claim 6, wherein an initial counter value Z=0 is provided and a step value of W=1 is provided, wherein the evaluation unit is configured to generate the fault signal when the counter value is Z>1.

8. The cableway according to claim 1, wherein at least one evaluation unit is provided per cableway support in order to process the sensor values of the sensors of the respective cableway support, or an evaluation unit is provided for a plurality of cableway supports in order to process the sensor values of the sensors of the plurality of cableway supports.

9. A method for detecting the passage of cable cars on a cableway support of a cableway, which support extends in the longitudinal direction of a conveyor cable guided on the cableway support over a cableway support length between two opposing support ends, wherein at least one cable car is moved on the conveyor cable over the cableway support, wherein the cable car is moved into an entry area provided in the area of a first support end of the cableway support, wherein at least one first sensor provided in the entry area detects the presence of the cable car in a detection area of the first sensor and transmits a sensor value to an evaluation unit, the cable car is moved from the entry area into an exit area of the cableway support provided in the area of the second end of the support, wherein at least one second sensor provided in the exit area detects the presence of the cable car in a detection area of the second sensor and transmits a sensor value to the evaluation unit, and the evaluation unit processes the received sensor values in order to determine a number of cable cars between the first and second sensors and generates a fault signal if the determined number exceeds a predetermined maximum number.

10. The method according to claim 9, wherein the fault signal is transmitted to a control unit for controlling the cableway and the control unit controls the cableway depending on the processing.

11. The method according to claim 9, wherein the evaluation unit increments a counter value by a step value if the first sensor in the entry area supplies a sensor value, and decrements the counter value by a step value if the second sensor in the exit area supplies a sensor value, or vice versa, and the evaluation unit generates the fault signal if the counter value exceeds a predetermined counter value.

12. The method according to claim 11, wherein an initial counter value of Z=0 is used and a step value of W=1 is used, wherein the evaluation unit generates the fault signal when the counter value is Z>1.

* * * * *